United States Patent [19]

Baudry et al.

[11] Patent Number: 4,812,706

[45] Date of Patent: Mar. 14, 1989

[54] DEVICE FOR CORRECTING THE DEFLECTION EFFECT DUE TO A VARIATION OF THE FOCUSING VOLTAGE IN A TRICHROMATIC CATHODE RAY TUBE WITH IN LINE CATHODES

[75] Inventors: Jacques Baudry, Ecully; Gérard Proudhon, Venissieux, both of France

[73] Assignee: Videocolor, Montrouge, France

[21] Appl. No.: 932,291

[22] Filed: Nov. 19, 1986

[30] Foreign Application Priority Data

Nov. 22, 1985 [FR] France ..... 85 17333

[51] Int. Cl.[4] ..... H01J 29/56

[52] U.S. Cl. ..... 313/414; 313/458

[58] Field of Search ..... 313/409, 412, 413, 414, 313/449, 458

[56] References Cited

U.S. PATENT DOCUMENTS 4,388,552 6/1983 Greninger ..... 313/449 X
4,583,024 4/1986 Chen ..... 313/414
4,614,894 9/1986 Izumida ..... 313/449 X
4,626,738 12/1986 Gerlach ..... 313/414

FOREIGN PATENT DOCUMENTS 0123351 10/1984 European Pat. Off. .
2258703 8/1975 France .

OTHER PUBLICATIONS

Patents Abstracts of Japan, vol. 4, No. 157 (E-32) [639], Nov. 4, 1980; & JP-A-55 108 153 (Matsushita Denshi Kogyo K.K.), 08-19-80.

*Primary Examiner*—David K. Moore
*Assistant Examiner*—K. Wieder
*Attorney, Agent, or Firm*—Oblon, Fisher, Spivak, McClelland & Maier

[57] ABSTRACT

To avoid the deflection phenomenon of the red and blue spots of a trichromatic tube with in line cathodes, as a function of a variation of the focusing voltage, the holes corresponding to these two colors are enlarged over a distance of about 0.1 to 0.2 mm.

9 Claims, 1 Drawing Sheet

DEVICE FOR CORRECTING THE DEFLECTION EFFECT DUE TO A VARIATION OF THE FOCUSING VOLTAGE IN A TRICHROMATIC CATHODE RAY TUBE WITH IN LINE CATHODES

BACKGROUND OF THE INVENTION

1. Field of the Invention

The present invention relates to a device for correcting the deflection effect due to a variation of the focusing voltage in a trichromatic cathode ray tube with in line cathodes.

2. Discussion of the Background

It has been discovered that in trichromatic cathode ray tubes, of the type with a gun having a prefocusing lens and a main lens, that is to say having generally five or six grids in all, when the focusing voltage is varied, passing for example from 8 to 10 kV, the position of the spots is modified corresponding to the red and blue colors, for illuminating the same luminophores. This phenomenon has been discovered during alignment tests of the gun (known as Focus Raster Alignment Test or FRAT). This modification of the position of the spots has a unfavorable action on the convergence.

To remedy this effect, the form of grid 2 is modified, which is then called "G2 with fixed FRAT", by stamping its central part. Such stamping causes inevitable deformation of the flat surfaces of the grid acting unfavorably on the astigmatism of the tube, which requires increasing the focusing voltage required for counterbalancing this phenomenon.

The present invention provides a device for correcting the above-mentioned effect, not requiring modification of G2, which remains flat, which device is simple and inexpensive to put into practice.

SUMMARY OF THE INVENTION

The device of the invention, for a trichromatic cathode ray tube with aligned cathodes, is a gun in which the end holes of the fourth grid corresponding generally to the red and blue colors, have differences of characteristics, with respect to their centers of origin, between their peripheral portions facing the central hole (corresponding to the green) and the rest of their periphery.

This difference of characteristics may be a difference of shape, or thickness, or level with respect to the general plane of the grid.

BRIEF DESCRIPTION OF THE DRAWINGS

The present invention will be better understood from reading the detailed description of several embodiments with reference to the accompanying drawings in which.

DESCRIPTION OF THE PREFERRED EMBODIMENTS

Figure 1:
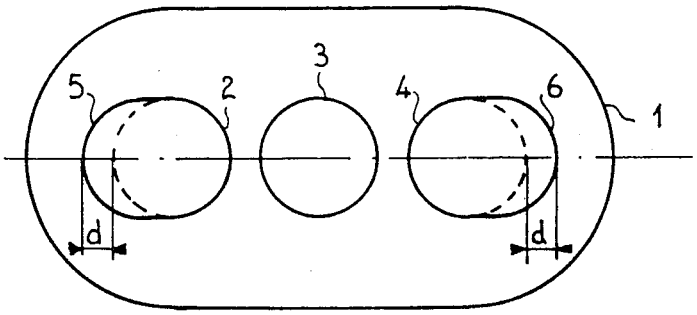
FIG. 1 is a top view of a preferred G4 embodiment in accordance with the invention.

The invention relates to trichromatic cathode ray tubes of the type having a gun with a prefocusing lens (grids 1 to 4 generally) and a main focusing lens (grids 5, and 6 if required, generally) and three emissive in line cathodes.

To counterbalance the above-mentioned phenomenon observed during FRAT tests, the present invention provides for modifying the fourth grid G4, and not the second one G2, which remains flat, without modifications for compensating this phenomenon. The applicant has discovered that modifications of the grid G4 were easier to put into practice and that there was a lesser risk of unfavorably influencing its usual properties than was the case for modifications to G2.

In the three embodiments of the invention shown in the drawings, we start with a conventional grid G4. As shown for example in FIG. 1, this fourth grid, referenced 1 and of an oblong shape, has originally three circular aligned and equidistant holes 2, 3, 4 for the passage of the electron beam illuminating the red, green and blue luminophores, respectively, of the trichromatic cathode ray tube of which this grid 1 forms part.

In FIG. 1, the end holes 2 and 4, circular originally, have been shown with broken lines in their end portions, i.e. their semicircular parts the furthest away from the central hole 3.

According to the invention, the holes 2 and 4 are enlarged in the direction of the longitudinal axis of grid 1, in the direction of its ends, so as to obtain oblong holes 5, 6 corresponding to a "translation" over the distance d, along said longitudinal axis, of holes 2 and 4 respectively. It has been discovered that for different cathode ray tubes, and for a focusing voltage between about 8 and 10 kV, this distance should generally be between about 0.1 and 0.2 mm so as to correctly counterbalance said phenomenon. In a preferred embodiment, for a gun having six focusing grids, and a focusing voltage of about 8 kV, the value of d is about 0.13 mm. In practice, this distance D is determined from two tests, for example a test at 0.10 mm and another at 0.20 mm, the value of the optimum distance being obtained by linear interpolation or extrapolation. If the value thus calculated were outside the desired range, a third confirmation test could be carried out with a distance d equal to the value calculated by extrapolation.

Figure 2:
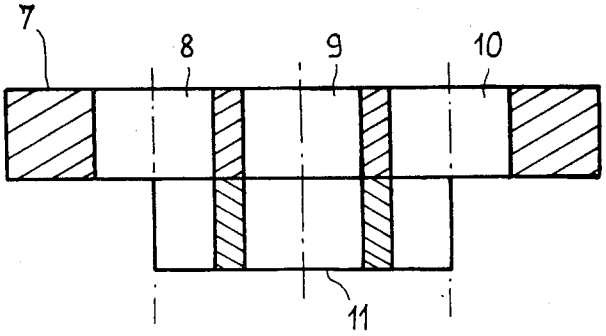
FIGS. 2 and 3 are sectional views of two other G4 embodiments in accordance with the invention.

In the embodiment shown in FIG. 2, a fourth grid 7 of usual shape is shown having the three usual holes 8, 9 and 10. On the lower face (that is to say the one turned towards the cathode) of grid 7 is fixed, by any appropriate means, a rectangular plate 11 of a width equal to that of grid 7, and of a length substantially equal to the distance between the axes of holes 8, 10 (those corresponding to the red and to the blue). Plate 11 and the grid 7 may be formed from the same material and have substantially the same thickness. With plate 11 centered with respect to grid 7, a central hole is counterbored in plate 11 in extension of hole 9, as well as two half-holes in extension of holes 8 and 10. The action of plate 11 may be finely adjusted by adjusting its length and/or its thickness. Of course, instead of adding a plate such as plate 11, a grid of greater thickness may be provided and the thickness reduced at its ends.

Figure 3:
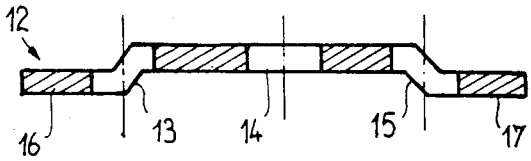

Grid 12, shown in FIG. 3, is at the outset a grid of usual shape whose rounded ends 16, 17 are counterbent towards the cathode, the counterbending being provided substantially at the level of the centers of end holes 13, 15. The correction provided by grid 12 may be finely adjusted by adjusting the amplitude of the counterbending, which is substantially equal to the thickness of grid 12.

For the two embodiments shown in FIGS. 2 and 3, the optimum values of the parameters (dimensions of grid 11 or amplitude of the counterbending of grid 12) are obtained by linear interpolation or extrapolation from two substantially closely related values of the above-mentioned mean value.

What is claimed is:

1. A device for correcting the deflection effect due to the variation of the focusing voltage in a trichromatic cathode ray tube with in line cathodes, of the type having five or six focusing grids and with a first plurality of said focusing grids forming a pre-focusing lens and with a second plurality of said grids forming a main focusing lens, wherein said focusing grids include a second flat grid and a fourth oblong grid having three aligned circuit or holes, wherein the fourth grid is one of said plurality of grids forming said pre-focusing lens and wherein said fourth grid is such that the geometric characteristics of the peripheral portion facing the central hole of the grid are different than the geometrical characteristics of the rest of its periphery, when taken with respect to its center of origin.

2. The correction device as claimed in claim 1, wherein said different geometric characteristics are differences in shape.

3. The device as claimed in claim 2, wherein the end holes are enlarged in the direction of the longitudinal axis of the grid, in the direction of its ends, so as to obtain oblong holes.

4. The device as claimed in claim 3, wherein the end holes are enlarged over a depth between about 0.1 and 0.2 mm.

5. The device as claimed in claim 1, wherein said different geometric characteristics are differences in thickness.

6. The device as claimed in claim 5, wherein the difference of thickness is obtained by fixing on the central part of the grid a plate having the same width as that of the grid and whose length is substantially equal to the distance between the axes of the end holes, holes being counterbored in this plate in extension of the holes of the grid.

7. The device as claimed in claim 5, wherein the difference of thickness is obtained by reducing the thickness of the ends of the grid.

8. The device as claimed in claim 1, wherein said different geometric characteristics are differences of level with respect to the general plane of the grid.

9. The device as claimed in claim 8, wherein the difference of level is obtained by counterbending the rounded ends of the grid, substantially at the height of the centers of the end holes of the grid.

* * * * *